US009235153B2

(12) United States Patent
Jin et al.

(10) Patent No.: US 9,235,153 B2
(45) Date of Patent: Jan. 12, 2016

(54) ELECTROSTATIC IMAGE DEVELOPER

(75) Inventors: Hiromichi Jin, Tokyo (JP); Takeru Chiba, Tokyo (JP); Hidehiko Iinuma, Gunma (JP); Kenichi Yamazaki, Gunma (JP)

(73) Assignees: ZEON CORPORATION, Tokyo (JP); KANTO DENKA KOGYO CO., LTD., Tokyo (JP)

( * ) Notice: Subject to any disclaimer, the term of this patent is extended or adjusted under 35 U.S.C. 154(b) by 0 days.

(21) Appl. No.: 14/118,277

(22) PCT Filed: May 18, 2012

(86) PCT No.: PCT/JP2012/062865

§ 371 (c)(1),
(2), (4) Date: Nov. 18, 2013

(87) PCT Pub. No.: WO2012/161138

PCT Pub. Date: Nov. 29, 2012

(65) Prior Publication Data

US 2014/0162180 A1 Jun. 12, 2014

(30) Foreign Application Priority Data

May 20, 2011 (JP) ..... 2011-113579

(51) Int. Cl.
*G03G 9/097* (2006.01)

(52) U.S. Cl.
CPC ..... *G03G 9/09708* (2013.01); *G03G 9/09725* (2013.01)

(58) Field of Classification Search
CPC ..... G03G 9/09708; G03G 9/09716; G03G 9/09725
USPC ..... 430/108.6
See application file for complete search history.

(56) References Cited

U.S. PATENT DOCUMENTS 6,703,175 B2 * 3/2004 Ebisu et al. ..... 430/108.6
7,826,772 B2 * 11/2010 Hirobe et al. ..... 399/223
2002/0192585 A1 * 12/2002 Brenner et al. ..... 430/108.6
2006/0177754 A1 8/2006 Miyakawa et al.
2009/0148692 A1 * 6/2009 Michos ..... 428/329

FOREIGN PATENT DOCUMENTS

| | | | | |
|---|---|---|---|---|
| JP | 2000-250251 | A | | 9/2000 |
| JP | 2001-318486 | A | | 11/2001 |
| JP | 2002-082475 | A | | 3/2002 |
| JP | 2005107066 | A | * | 4/2005 |
| JP | 2006-201562 | A | | 8/2006 |
| JP | 2007-017654 | A | | 1/2007 |
| JP | 2007-148198 | A | | 6/2007 |
| JP | 2008-096883 | A | | 4/2008 |
| JP | 2008-195569 | A | | 8/2008 |
| JP | 2009-227485 | A | | 10/2009 |
| WO | 2003/065125 | A1 | | 8/2003 |

OTHER PUBLICATIONS

English language machine translation of JP 2005-107066 (Apr. 2005).*

International Search report dated Aug. 28, 2012, issued in corresponding application No. PCT/JP2012/062865.

* cited by examiner

*Primary Examiner* — Christopher Rodee

(74) *Attorney, Agent, or Firm* — Westerman, Hattori, Daniels & Adrian, LLP

(57) ABSTRACT

An electrostatic image developer having little change in charge amount, no generation of fog and excellent environmental stability under all of low temperature and low humidity environment, normal temperature and normal humidity environment, and high temperature and high humidity environment is provided. Disclosed is an electrostatic image developer comprising a colored resin particle containing a binder resin and a colorant, and an external additive, wherein the external additive contains an alumina fine particle in plate-like shape subjected to a hydrophobicity-imparting treatment having a number average primary particle diameter of 20 to 120 nm and an aspect ratio of 3 to 15, and a content of the alumina fine particle is in the range from 0.05 to 1 part by mass with respect to 100 parts by mass of the colored resin particle.

6 Claims, 1 Drawing Sheet

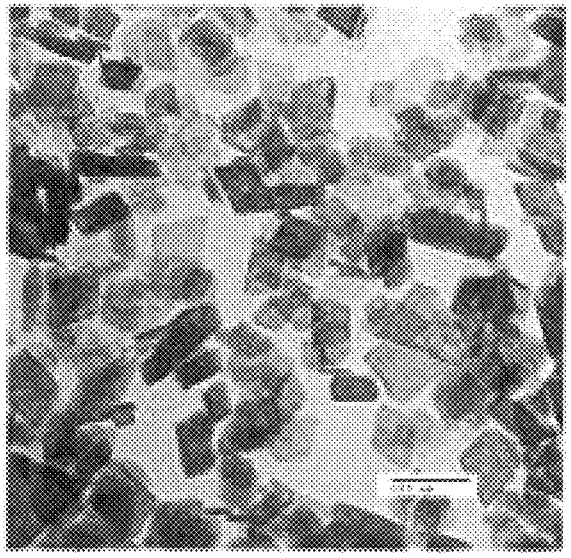

ELECTROSTATIC IMAGE DEVELOPER

TECHNICAL FIELD

The present invention relates to an electrostatic image developer (hereinafter, it may be simply referred to as "developer") used for development of latent electrostatic images in electrophotography, the electrostatic recording method, the electrostatic printing process or the like.

BACKGROUND ART

Conventionally, developers generally used in electrophotography can have a desired flowability and charging characteristics by attaching external additives on the surfaces of colored resin particles. As external additives, inorganic particles and organic particles are generally used.

Conventionally as the external additives, metal oxide particles, resin particles and these materials subjected to a surface treatment have been widely used. Among them, particularly, particles of metal oxide such as silica, titania and alumina, and these materials subjected to a hydrophobicity-imparting treatment are often used.

Silica fine particles having various particle diameters are generally used as external additives, while many inventions using alumina fine particle are also known.

For example, Patent Literature 1 discloses alumina powder for a toner additive defined by shape, particle diameter and particle size distribution used as an electrophotographic developer. It is mentioned in paragraph [0035] of the specification of Patent Literature 1 that an electrophotographic developer having no drum filming, improved image quality and excellent durability can be obtained by using the alumina powder.

Patent Literature 2 discloses a toner for nonmagnetic single-component development containing alumina particles having an $Al_2O_3$ content of 90% or more by mass attached on the surfaces of toner particles. It is mentioned in paragraph [0029] of the specification of Patent Literature 2 that the toner using the alumina particles has image characteristics of little fog, excellent reproducibility of a solid patterned image with 100% image density and excellent transferability.

Patent Literature 3 discloses a toner obtained by externally adding alumina fine particles having a specific purity, primary particle diameter and ion content to colored particles having a specific shape and particle size distribution. Examples in the specification of Patent Literature 3 disclose the evaluation on image fog, transfer failure, charging failure and image striping of images printed out using the toner.

It is also known to use metallic compounds other than metal oxides as external additives. For example, Patent Literature 4 discloses a developer for electrostatic image development obtained by externally adding cubic calcium carbonate to coloring particles. It is mentioned in pages 14 to 15 of the specification of Patent Literature 4 that the cleaning property and transferability are excellent, no filming occurs on a photosensitive member, and an image having no fog and blur can be formed by the developer.

Patent Literatures 5 and 6 disclose an alumina fine particle having an aspect ratio of 3 or less is excellent in dispersibility.

CITATION LIST

Patent Literature

Patent Literature 1: Japanese Patent Application Laid-Open (JP-A) No. 2000-250251
Patent Literature 2: JP-A No. 2001-318486

Patent Literature 3: JP-A No. 2007-017654
Patent Literature 4: International Publication No. 2003/065125
Patent Literature 5: JP-A No. 2008-195569
Patent Literature 6: JP-A No. 2009-227485

SUMMARY OF INVENTION

Technical Problem

Examples regarding evaluation on drum filming of toners are disclosed in paragraphs [0021]-[0034] of the specification of Patent Literature 1. Also, Examples regarding evaluation on image density of toners, etc. are disclosed in paragraphs [0020]-[0028] of the specification of Patent Literature 2. Also, Examples regarding evaluation on image fog, etc. are disclosed in paragraphs [0151]-[0214] of the specification of Patent Literature 3 as mentioned above. Also, Examples regarding evaluation on cleaning property, etc. are disclosed in pages 12 to 14 of the specification of Patent Literature 4 as mentioned above.

However, all of these patent literatures do not disclose that the developers of these patent literatures have little change in charge amount and no generation of fog and exhibit excellent environmental stability under various environments.

Therefore, an object of the present invention is to provide an electrostatic image developer having little change in charge amount, little generation of fog and excellent environmental stability under all of low temperature and low humidity environment, normal temperature and normal humidity environment, and high temperature and high humidity environment.

Solution to Problem

As a result of diligent researches to solve the above problems, the inventors of the present invention have found out that the above problems can be solved by, in a toner comprising colored resin particles and an external additive, containing a specific amount of alumina fine particles subjected to a hydrophobicity-imparting treatment and having a specific particle diameter and shape with respect to the amount of the colored resin particles.

That is, according to the present invention, an electrostatic image developer comprising a colored resin particle containing a binder resin and a colorant, and an external additive is provided, wherein the external additive contains an alumina fine particle in plate-like shape subjected to a hydrophobicity-imparting treatment having a number average primary particle diameter of 20 to 120 nm and an aspect ratio of 3 to 15, and a content of the alumina fine particles is in the range from 0.05 to 1 part by mass with respect to 100 parts by mass of the colored resin particle.

In the present invention, Dv90/Dv10 of the alumina fine particle is preferably in the range from 1.5 to 3.0, wherein Dv10 represents a particle diameter at which a volume cumulative total from small particle diameter side of a particle size distribution is 10%, and Dv90 represents a particle diameter at which the volume cumulative total from small particle diameter side of the particle size distribution is 90%.

It is preferable in the present invention that the external additive contains a silica fine particle A having a number average primary particle diameter of 5 to 30 nm, and a content of the silica fine particle A is in the range from 0.1 to 2 parts by mass with respect to 100 parts by mass of the colored resin particle.

It is preferable in the present invention that the external additive contains a silica fine particle B having a number average primary particle diameter of 35 to 80 nm, and a content of the silica fine particle B is in the range from 0.2 to 3 parts by mass with respect to 100 parts by mass of the colored resin particle.

In the present invention, the alumina fine particle may be prepared by subjecting a boehmite particle obtainable by a hydrothermal reaction to firing and a hydrophobicity-imparting treatment.

In the present invention, the boehmite particle may be prepared by adding a fatty acid salt to an aluminium hydroxide particle followed by a hydrothermal reaction.

Advantageous Effects of Invention

According to the aforementioned present invention, an electrostatic image developer having little change in charge amount, no generation of fog and excellent in environmental stability under all of low temperature and low humidity environment, normal temperature and normal humidity environment, and high temperature and high humidity environment, can be obtained.

BRIEF DESCRIPTION OF DRAWINGS

FIGURE shows a TEM image of alumina fine particles 1.

DESCRIPTION OF EMBODIMENTS

An electrostatic image developer of the present invention comprises a colored resin particle containing a binder resin and a colorant, and an external additive, wherein the external additive contains an alumina fine particle in plate-like shape subjected to a hydrophobicity-imparting treatment having a number average primary particle diameter of 20 to 120 nm and an aspect ratio of 3 to 15, and a content of the alumina fine particle is in the range from 0.05 to 1 part by mass with respect to 100 parts by mass of the colored resin particle.

Hereinafter, the developer of the present invention will be described.

The developer of the present invention comprises a colored resin particle containing a binder resin and a colorant, and the above alumina fine particle meeting the specific condition as an external additive in the specific amount.

The developer of the present invention is preferably obtained by attaching the alumina fine particles as the external additive on the surfaces of the colored resin particles.

Hereinafter, a method for producing the colored resin particles used in the present invention, the colored resin particles obtained by the production method, a method for producing the developer of the present invention using the colored resin particles and the alumina fine particles, and the developer of the present invention will be described in this order.

1. Method for Producing Colored Resin Particles

Generally, methods for producing the colored resin particles are broadly classified into dry methods such as a pulverization method and wet methods such as an emulsion polymerization agglomeration method, a suspension polymerization method and a solution suspension method. The wet methods are preferable since developers having excellent printing characteristics such as image reproducibility can be easily obtained. Among the wet methods, polymerization methods such as the emulsion polymerization agglomeration method and the suspension polymerization method are preferable since developers which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing developer components such as a binder resin and a colorant dissolved or dispersed in an organic solvent, and removing the organic solvent. Both methods can be performed by known methods.

The colored resin particles of the present invention can be produced by employing the wet methods or the dry methods. The suspension polymerization method preferable among the wet methods is performed by the following processes.

(A) Suspension Polymerization Method (A-1) Preparation Process of Polymerizable Monomer Composition First, a polymerizable monomer, a colorant, and other additives such as a release agent, a charge control agent, etc., which are added if required, are mixed to prepare a polymerizable monomer composition. For example, a media type dispersing machine or an in-line emulsifying dispersing machine is used for the mixing upon preparing the polymerizable monomer composition.

In the present invention, the polymerizable monomer means a monomer having a polymerizable functional group, and the polymerizable monomer is polymerizable to be a binder resin. As a main component of the polymerizable monomer, a monovinyl monomer is preferably used. Examples of the monovinyl monomer include: styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and acrylic acid esters or methacrylic acid esters are suitably used for the monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer to be used is generally in the range from 0.1 to 5 parts by mass, preferably from 0.3 to 2 parts by mass, with respect to 100 parts by mass of the monovinyl monomer.

Further, it is preferable to use macromonomer as part of the polymerizable monomer since the balance of the shelf stability and low-temperature fixability of the developer to be obtained can be improved. The macromonomer is a reactive oligomer or polymer having a polymerizable carbon-carbon unsaturated double bond at the end of a polymer chain and generally having a number average molecular mass of 1,000 to 30,000. A preferable macromonomer is one capable of providing a polymer having higher glass transition temperature (hereinafter may be referred to as "Tg") than a polymer obtained by the polymerization of the monovinyl monomer.

The macromonomer to be used is preferably in the range from 0.03 to 5 parts by mass, more preferably from 0.05 to 1 part by mass, with respect to 100 parts by mass of the monovinyl monomer.

In the present invention, a colorant is used. To produce a color developer, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used include compounds including azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 213, 237, 251 and 269, and C. I. Pigment Violet 19.

In the present invention, these colorants can be used alone or in combination of two or more kinds. The amount of the colorant is preferably in the range from 1 to 10 parts by mass with respect to 100 parts by mass of the monovinyl monomer.

From the viewpoint of improving the releasing characteristics of the developer from a fixing roller at fixing, the release agent is preferably added to the polymerizable monomer composition. The release agent can be used without any particular limitation as long as it is generally used as a release agent for the developer.

The release agent preferably contains at least one of an ester wax and a hydrocarbon wax. By using at least one of the above waxes as the release agent, the balance of low-temperature fixability and shelf stability can be improved.

In the present invention, examples of the ester wax which is suitably used as the release agent include: monoester compounds such as stearyl stearate and behenyl behenate; pentaerythritol ester compounds such as pentaerythritol tetrapalmitate, pentaerythritol tetrabehenate and pentaerythritol tetrastearate; glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate and glycerin tribehenate; and dipentaerythritol ester compounds such as dipentaerythritol hexamyristate and dipentaerythritol hexapalmitate. Among them, monoester compounds are preferable.

Examples of the hydrocarbon wax suitably used as the release agent in the present invention include a polyethylene wax, a polypropylene wax, a Fischer-Tropsch wax, a petroleum wax and the like. Preferred are a Fischer-Tropsch wax and a petroleum wax, and more preferred is a petroleum wax.

The number average molecular mass of the hydrocarbon wax is preferably in the range from 300 to 800, more preferably from 400 to 600. A needle penetration of the hydrocarbon wax measured with reference to JIS K2235 5.4 is preferably in the range from 1 to 10, more preferably from 2 to 7.

In addition to the above release agents, natural waxes such as jojoba and mineral waxes such as ozokerite can be used, for example.

These release agents may be used alone or in combination of two or more kinds.

The amount of the release agent to be used is preferably in the range from 0.1 to 30 parts by mass, more preferably from 1 to 20 parts by mass, with respect to 100 parts by mass of the monovinyl monomer.

As one of other additives, a charge control agent having positively charging ability or negatively charging ability can be used to improve the charging ability of the developer.

The charge control agent is not particularly limited as long as it is generally used as a charge control agent for a developer. Among the charge control agents, a charge control resin having positively charging ability or negatively charging ability is preferably used since the charge control resin is highly compatible with the polymerizable monomer and can impart stable charging ability (charge stability) to the developer particles. From the viewpoint of obtaining a positively-chargeable developer, the charge control resin having positively charging ability is more preferably used.

Examples of the charge control agent having positively charging ability include a nigrosine dye, a quaternary ammonium salt, a triaminotriphenylmethane compound, an imidazole compound, a polyamine resin preferably used as the charge control resin, a quaternary ammonium group-containing copolymer and a quaternary ammonium salt group-containing copolymer.

Examples of the charge control agent having negatively charging ability include: azo dyes containing metal such as Cr, Co, Al and Fe; metal salicylate compounds; metal alkylsalicylate compounds; and sulfonic acid group-containing copolymers, sulfonic acid base-containing copolymers, carboxylic acid group-containing copolymers and carboxylic acid base-containing copolymers which are preferably used as charge control resins.

In the present invention, it is desirable that the amount of the charge control agent to be used is generally in the range from 0.01 to 10 parts by mass, preferably from 0.03 to 8 parts by mass, with respect to 100 parts by mass of the monovinyl monomer. If the added amount of the charge control agent is less than 0.01 parts by mass, fog may occur. On the other hand, if the added amount of the charge control agent exceeds 10 parts by mass, printing soiling may occur.

As one of other additives, a molecular weight modifier is preferably used upon the polymerization of the polymerizable monomer which is polymerized to be a binder resin.

The molecular weight modifier is not particularly limited as long as it is generally used as a molecular weight modifier for a developer. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally in the range from 0.01 to 10 parts by mass, more preferably from 0.1 to 5 parts by mass, with respect to 100 parts by mass of the monovinyl monomer.

(A-2) Suspension Process of Obtaining Suspension (Droplets Forming Process)

In the present invention, the polymerizable monomer composition comprising at least a polymerizable monomer and a colorant is dispersed in an aqueous medium containing a dispersion stabilizer, and a polymerization initiator is added therein. Then, the droplets of the polymerizable monomer composition are formed. The method for forming droplets is not particularly limited. The droplets are formed by means of a device capable of strong stirring such as an in-line type emulsifying and dispersing machine (product name: MILDER; manufactured by Ebara Corporation), and a high-speed emulsification dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2amidinopropane)dihydrochloride, 2,2'-azobis (2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylbutanoate, diisopropylperoxydicarbonate, di-t-butlyperoxyisophthalate and t-butylperoxyisobutyrate. These can be used alone or in combination of two or more kinds. Among them, the organic peroxides are preferably used since they can reduce residual polymerizable monomer and can impart excellent printing durability.

Among the organic peroxides, preferred are peroxy esters, and more preferred are non-aromatic peroxy esters, i.e. peroxy esters having no aromatic ring, since they have excellent initiator efficiency and can reduce a residual polymerizable monomer.

The polymerization initiator may be added after dispersing the polymerizable monomer composition to the aqueous medium and before forming droplets as described above, or may be added to the polymerizable monomer composition before the polymerizable monomer composition is dispersed in the aqueous medium.

The added amount of the polymerization initiator used in the polymerization of the polymerizable monomer composition is preferably in the range from 0.1 to 20 parts by mass, more preferably from 0.3 to 15 parts by mass, even more preferably from 1 to 10 parts by mass, with respect to 100 parts by mass of the monovinyl monomer.

In the present invention, the aqueous medium means a medium containing water as a main component.

In the present invention, the dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin, anionic surfactants; nonionic surfactants; and ampholytic surfactants. These dispersion stabilizers can be used alone or in combination of two or more kinds.

Among the above dispersion stabilizers, colloid of inorganic compounds, particularly hardly water-soluble metal hydroxide, is preferable. By using the colloid of inorganic compounds, particularly hardly water-soluble metal hydroxide, the colored resin particles can have a small particle size distribution, so that the amount of the dispersion stabilizer remained after washing is small, thus the image can be clearly reproduced by the polymerized developer to be obtained; moreover, the colloid of inorganic compounds does not deteriorate environmental stability.

(A-3) Polymerization Process

After the droplets are formed as described in the above (A-2), thus obtained aqueous dispersion medium is heated to polymerize. Thereby, an aqueous dispersion of colored resin particles is formed.

The polymerization temperature of the polymerizable monomer composition is preferably 50° C. or more, more preferably in the range from 60 to 95° C. The polymerization reaction time is preferably in the range from 1 to 20 hours, more preferably in the range from 2 to 15 hours.

The colored resin particle may be used as a polymerized developer obtained by adding an external additive. It is preferable that the colored resin particle is so-called core-shell type (or "capsule type") colored resin particle which is obtained by using the colored resin particle as a core layer and forming a shell layer, a material of which is different from that of the core layer, around the core layer. The core-shell type colored resin particles can take a balance of lowering fixing temperature and prevention of blocking at storage, since the core layer including a substance having a low softening point is covered with a substance having a higher softening point.

A method for producing the above-mentioned core-shell type colored resin particles using the colored resin particles is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer for forming a shell layer (a polymerizable monomer for shell) and a polymerization initiator are added to an aqueous medium to which the colored resin particles are dispersed followed by polymerization, thus the core-shell type colored resin particles can be obtained.

As the polymerizable monomer for shell, the above-mentioned polymerizable monomer can be similarly used. Among the polymerizable monomers, any of monomers which provide a polymer having Tg of more than 80° C. such as styrene, acrylonitrile and methyl methacrylate is preferably used alone or in combination of two or more kinds.

Examples of the polymerization initiator used for polymerization of the polymerizable monomer for shell include: water-soluble polymerization initiators including metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl)-2-hydroxyethyl)propionamide). These polymerization initiators can be used alone or in combination of two or more kinds. The amount of the polymerization initiator is preferably in the range from 0.1 to 40 parts by mass, more preferably from 1 to 30 parts by mass, with respect to 100 parts by mass of the polymerizable monomer for shell.

The polymerization temperature of the shell layer is preferably 50° C. or more, more preferably in the range from 60 to 95° C. The polymerization reaction time is preferably in the range from 1 to 20 hours, more preferably from 2 to 15 hours.

(A-4) Processes of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying several times as needed after the polymerization, according to any conventional method.

In the washing method, if the inorganic compound is used as the dispersion stabilizer, it is preferable that acid or alkali is added to the aqueous dispersion of colored resin particles; thereby, the dispersion stabilizer is dissolved in water and removed. If colloid of hardly water-soluble inorganic hydroxide is used as the dispersion stabilizer, it is preferable to control pH of the aqueous dispersion of colored resin particles to 6.5 or less. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

The methods for dehydrating and filtering are not particularly limited, and any of various known methods can be used. Examples of the filtration method include a centrifugal filtration method, a vacuum filtration method and a pressure filtration method. Also, the drying method is not particularly limited, and any of various methods can be used.

(B) Pulverization Method

In the case of producing the colored resin particles by employing the pulverization method, the following processes are performed.

First, a binder resin, a colorant, and other additives such as a charge control agent and a release agent, which are added if required, are mixed by means of a mixer such as a ball mill, a V type mixer, Henschel Mixer (product name), a high-speed dissolver, an internal mixer or a whole burg. Next, the above-obtained mixture is kneaded while heating by means of a press kneader, a twin screw kneading machine or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as a wind classifier or an airflow classifier. Thus, colored resin particles produced by the pulverization method can be obtained.

The binder resin, the colorant, and other additives such as the charge control agent and the release agent, which are added if required, used in "(A) Suspension polymerization method" can be used in the pulverization method. Similarly as the colored resin particles obtained by "(A) Suspension polymerization method", the colored resin particles obtained by the pulverization method can also be in a form of the core-shell type colored resin particles produced by a method such as the in situ polymerization method.

As the binder resin, other resins which are conventionally and broadly used for developers can be used. Specific examples of the binder resin used in the pulverization method include polystyrene, styrene-butyl acrylate copolymers, polyester resins and epoxy resins.

2. Colored Resin Particles

The colored resin particles are obtained by the above production method such as (A) Suspension polymerization method or (B) Pulverization method.

Hereinafter, the colored resin particles constituting the developer will be described. The colored resin particles hereinafter include both core-shell type colored resin particles and colored resin particles which are not core-shell type.

The volume average particle diameter (Dv) of the colored resin particles is preferably in the range from 4 to 12 μm, more preferably from 5 to 10 μm. If the volume average particle diameter (Dv) of the colored resin particles is less than 4 μm, the flowability of the polymerized developer may lower, the transferability may deteriorate, and the image density may decrease. If the volume average particle diameter (Dv) of the colored resin particles exceeds 12 μm, the resolution of images may decrease.

As for the colored resin particles, a ratio (particle size distribution (Dv/Dn)) of the volume average particle diameter (Dv) and the number average particle diameter (Dn) is preferably in the range from 1.0 to 1.3, more preferably from 1.0 to 1.2. If "Dv/Dn" exceeds 1.3, the transferability, image density and resolution may decrease. The volume average particle diameter and the number average particle diameter of the colored resin particles can be measured, for example, by means of a particle diameter measuring device (product name: MULTISIZER; manufactured by Beckman Coulter, Inc.), etc.

The average circularity of the colored resin particles of the present invention is preferably in the range from 0.96 to 1.00, more preferably from 0.97 to 1.00, even more preferably from 0.98 to 1.00, from the viewpoint of image reproducibility.

If the average circularity of the colored resin particles is less than 0.96, the reproducibility of thin lines may decrease.

In the present invention, circularity is a value obtained by dividing a perimeter of a circle having an area same as a projected area of a particle by a perimeter of a projected particle image. Also, in the present invention, an average circularity is used as a simple method of quantitatively presenting shapes of particles and is an indicator showing the level of convexo-concave shapes of the colored resin particles. The average circularity is "1" when each of the colored resin particles is an absolute sphere, and the value becomes smaller as the shape of the surface of each of the colored resin particles becomes more complex.

3. Method for Producing Developer of the Present Invention

The colored resin particles obtained by the aforementioned "(A) Suspension polymerization method" or "(B) Pulverization method" are mixed and agitated together with an external additive containing alumina fine particles hereinafter described. Thereby, the external additive can be uniformly and suitably attached (externally added) on the surfaces of the colored resin particles.

A method for attaching (externally adding) the external additive such as the alumina fine particles hereinafter described on the surfaces of the colored resin particles is not particularly limited, and any device capable of mixing and agitating can be used.

As a device capable of mixing and agitating, representative examples of high speed agitators include Henschel mixer (product name; manufactured by Mitsui Mining Co., Ltd.), SUPERMIXER (product name; manufactured by Kawata Manufacturing Co., Ltd.), Q mixer (product name; manufactured by Mitsui Mining Co., Ltd.), Mechanofusion System (product name; manufactured by Hosokawa Micron Corporation), Mechanomill (product name; manufactured by Okada Seiko Co., Ltd.), and NOBILTA (product name; manufactured by Hosokawa Micron Corporation).

The developer of the present invention contains, as the external additive, the alumina fine particles in plate-like shape subjected to a hydrophobicity-imparting treatment having a number average primary particle diameter of 20 to 120 nm and an aspect ratio of 3 to 15, in the range from 0.05 to 1 part by mass with respect to 100 parts by mass of the colored resin particles.

The production method of the alumina fine particle used in the present invention may not be particularly limited if the above conditions are satisfied. The preferable process, which can easily obtain alumina fine particles satisfying the above conditions, is as follows. After an aluminium compound which becomes acidic when dissolved in water (hereinafter, it may be referred as "acidic aluminium compound") such as aluminium nitrate, aluminium sulfate, aluminium chloride or hydrates thereof, and an alkali hydroxide compound which becomes alkali when dissolved in water such as sodium hydroxide or potassium hydroxide are subjected to neutralization to produce an aluminium hydroxide compound, a hydrothermal reaction is performed. Then, after the resultant is subjected to filtration, water washing and drying to obtain boehmite fine particles, a high-temperature treatment is performed. The hydrothermal reaction is a reaction to precipitate and grow crystal under a high-temperature and high-pressure in the presence of hot water. The reaction temperature is preferably in the range from 100° C. or more, more preferably in the range from 200 to 400° C. The reaction pressure is preferably 0.1 MPa or more, more preferably in the range from 20 to 40 MPa. The reaction time is preferably 30 seconds or more, preferably in the range from 30 seconds to 8 hours. In the high-temperature treatment, the treating temperature is preferably in the range from 500 to 1,000° C., and the treating time is preferably in the range from 0.01 to 8 hours. By setting such conditions, the alumina fine particle used in the present invention can be preferably obtained.

The alumina fine particle in plate-like shape has substantially plate-like three-dimensional shape, preferably square-plate shape, which may include such particles having a little deformation, for example, such particles in plate-like shape with rounded corners.

It is presumed that the use of the alumina fine particle in plate-like shape as the external additive has the effect of accelerating the charge transfer between developer particles and uniforming the charge amount of the developer.

If the number average primary particle diameter of the alumina fine particles used in the present invention is less than 20 nm, the charge amount under a high temperature and high humidity (H/H) environment significantly decreases, and fogging in printing occurs. On the other hand, if the number average primary particle diameter of the alumina fine particles used in the present invention is more than 120 nm, the charge amount significantly increases under a low temperature and low humidity (L/L) environment, and fogging in printing occurs. The number average primary particle diameter of the alumina fine particles used in the present invention is preferably in the range from 30 to 100 nm, more preferably in the range from 40 to 80 nm, even more preferably in the range from 50 to 70 nm.

The number average primary particle diameter can be measured, for example, by the following method. First, the major axis of each particle is measured by transmission electron microscope (TEM), etc., which is referred as the particle diameter of the alumina fine particle. Next, the particle diameter of 200 or more alumina fine particles are measured, the mean value of which is referred as the number average primary particle diameter of the alumina fine particles. As aforementioned, the alumina fine particles used in the present invention may include such particles in plate-like shape with rounded corners and such particles in plate-like shape with a curving side, however, even these fine particles are regarded as approximately cuboid to measure the particle diameter.

The number average primary particle diameter of the alumina fine particles tends to increase if the hydrothermal temperature in the hydrothermal reaction is increased or the dwell time is extended. The dwell time is preferably in the range from 0.2 to 60 minutes. If the dwell time is less than 0.2 minutes, the number average primary particle diameter may be small. On the other hand, if the dwell time exceeds 60 minutes, the number average primary particle diameter may be too large.

It is more preferable that the dwell time is in the range from 0.5 to 30 minutes.

If the aspect ratio of the alumina fine particle is less than 3, the charge amount largely changes and the property of the developer largely changes due to the difference of the environment. On the other hand, if the aspect ratio exceeds 15, the shape of the alumina fine particle is not in plate-like shape but is in needle-like shape, etc., which causes the alumina fine particles to be easily released from toner particles, and the effect of the present invention cannot be exhibited. The aspect ratio is preferably in the range from 3 to 10, more preferably in the range from 3.5 to 8, and even more preferably in the range from 4 to 6.

The aspect ratio can be measured, for example, in the following manner. First, the minor axis of each particle is measured by TEM, etc., which is referred as a thickness of the alumina fine particle. Next, the thicknesses of 200 or more alumina fine particles are measured, the mean value of which is referred as the average thickness of the alumina fine particles. The value obtained by dividing the number average primary particle diameter by the average thickness is referred as the aspect ratio of the alumina fine particles.

The aspect ratio of the alumina fine particles tends to decrease if the hydrothermal temperature in the hydrothermal reaction method increases, and to increase if the degree of neutralization increases. The hydrothermal temperature is preferably in the range from 100 to 450° C. The degree of neutralization is preferably in the range from 0.8 to 2.0. If the hydrothermal temperature is below 100° C., the aspect ratio may be too large. On the other hand, if the hydrothermal temperature exceeds 450° C., the aspect ratio may be too small. In addition, if the degree of neutralization is less than 0.8, the aspect ratio may be too small. On the other hand, if the degree of neutralization exceeds 2.0, the aspect ratio may be too large.

It is more preferable that the hydrothermal temperature is in the range from 250 to 400° C., and the degree of neutralization is in the range from 0.9 to 1.2.

Herein, the degree of neutralization refers to the equivalent number of hydroxyl groups of alkali hydroxide compound used for neutralization with respect to the equivalent number of aluminium of acidic aluminium compound.

If the content of the alumina fine particles used in the present invention is less than 0.05 parts by mass with respect to 100 parts by mass of the colored resin particles, the charge amount under a low temperature and low humidity (L/L) environment significantly increases, and fogging in printing occurs. On the other hand, if the content of the alumina fine particles used in the present invention exceeds 1 part by mass, the charge amount under a high temperature and high humidity (H/H) environment significantly decreases, and fogging in printing occurs. The content of the alumina fine particles used in the present invention is preferably in the range from 0.1 to 0.5 parts by mass, more preferably in the range from 0.2 to 0.4 parts by mass, with respect to 100 parts by mass of the colored resin particles.

Though detailed mechanism is unknown, it is presumed that the effect of uniforming the charge amount of the developer is exhibited when the content of the alumina fine particles with respect to the content of the colored resin particles is within the above range.

The Dv90/Dv10 of the alumina fine particles is preferably in the range from 1.5 to 3.0, wherein Dv10 represents a particle diameter at which a volume cumulative total from small particle diameter side of the particle size distribution is 10% and Dv90 represents a particle diameter at which the volume cumulative total from small particle diameter side of the particle size distribution is 90%.

An alumina fine particle having a Dv90/Dv10 of less than 1.5 is difficult for the present technology to produce. On the other hand, if alumina fine particles having a Dv90/Dv10 exceeding 3.0 are used, the alumina fine particles attach to the colored resin particles unevenly, which may cause differences in external addition effect.

Dv10 and Dv90 may be measured by means of particle diameter measurement apparatus such as dynamic light scattering type particle size distribution measurement apparatus.

It is necessary that the alumina fine particle used as the external additive in the present invention is subjected to a hydrophobicity-imparting treatment, preferably by a hydrophobicity-imparting treatment agent such as a silane coupling agent, silicone oil, fatty acid or a metal salt of fatty acid. As the hydrophobicity-imparting treatment agent, the silane coupling agent and the silicone oil are more preferable from the viewpoint of obtaining high image quality.

Examples of the silane coupling agent include disilazanes such as hexamethyldisilazane; cyclic silazanes; alkylsilane compounds such as trimethylsilane, trimethylchlorosilane, dimethyldichlorosilane, methyltrichlorosilane, allyl dimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane and vinyltriacetoxysilane; and aminosilane compounds such as γ-aminopropyltriethoxysilane, γ-(2-aminoethyl)aminopropyltrimethoxysilane, γ-(2-aminoethyl) aminopropylmethyldimethoxysilane, aminosilane, N-(2-aminoethyl)-3-aminopropyltrimethoxysilane and N-β-(N-vinylbenzylaminoethyl)-γ-aminopropyltrimethoxysilane.

Examples of the silicone oil include dimethyl polysiloxane, methyl hydrogen polysiloxane, methylphenylpolysiloxane and amino-modified silicone oil.

These hydrophobicity-imparting treatment agents can be used alone or in combination of two or more kinds.

In the case of obtaining a developer having positively charging ability, it is more preferable to use a silicon compound containing an amino group such as an aminosilane compound or an amino-modified silicone oil, even more preferably the amino-modified silicone oil, since a developer having excellent positively charging ability can be easily obtained. In this case, in order to impart high positively charging ability and hydrophobicity, it is preferable to use both a silicon compound containing an amino group and a silicon compound not containing an amino group as hydrophobicity-imparting treatment agents. The hydrophobicity-imparting treatment may be performed by well-known methods similarly as silica used as an external additive of a toner.

It is presumed that the silane coupling agent and silicone oil react with aluminol groups on the surfaces of the alumina fine particles.

The alumina fine particles used in the present invention can be produced by subjecting boehmite (alumina monohydrate) particles obtained by the hydrothermal reaction method to firing and a hydrophobicity-imparting treatment.

The production example of alumina fine particle subjected to a hydrophobicity-imparting treatment is as follows. First, aluminium hydroxide being a starting material is produced by Bayer process, etc. Next, using thus obtained aluminium hydroxide, boehmite particles are produced by the hydrothermal reaction method. The detail of the hydrothermal reaction method is not particularly limited. For example, a crystal control agent such as NaOH is added to aluminium hydroxide to cause the hydrothermal reaction, or an aqueous solution of aluminium salt and an alkali aqueous solution are added to aluminium hydroxide to cause the hydrothermal reaction. Also, a device such as a continuous hydrothermal reaction device may be used for the hydrothermal reaction. Next, thus obtained boehmite particles are fired at high temperature to produce alumina fine particles. In the case of firing at high temperature, the treating temperature is preferably in the range from 500 to 1,000° C., and the treating time is preferably in the range from 0.01 to 8 hours.

Finally, the obtained alumina fine particles are treated with the aforementioned hydrophobicity-imparting treatment agent. Thereby, alumina fine particles subjected to a hydrophobicity-imparting treatment can be obtained.

The aluminium hydroxide particles before the hydrothermal reaction are approximately amorphous. Even if they are rinsed in water, it is difficult to remove impurities (for example, Cl, S, Na, etc.) derived from the starting material. Through the hydrothermal reaction, the crystallinity of the alumina fine particles can be high and crystal particle diameter can be large, in addition, impurities can be removed and high purity can be obtained during the crystal growth. Also, by having high crystallinity, the dispersibility of the alumina fine particles improves.

In the hydrothermal reaction, a fatty acid salt such as sodium oleate may be added. If the added amount of fatty acid salt increases, the number average primary particle diameter of the obtainable alumina fine particles tends to decrease. The amount of the fatty acid salt to be added upon the hydrothermal reaction is preferably in the range from 0.01 to 5 wt % with respect to the theoretical boehmite particle yield.

In the present invention, besides the alumina fine particle, a silica fine particle A having a number average primary particle diameter of 5 to 30 nm is preferably contained as the external additive.

If the number average primary particle diameter of silica fine particles A is less than 5 nm, the silica fine particle A may not stay on the surface of the colored resin particle but may be easily buried into the colored resin particle, a sufficient flowability cannot be imparted to developer particles, and printing performance may be adversely affected. On the other hand, if the number average primary particle diameter of silica fine particles A exceeds 30 nm, since the ratio (coverage) of the silica fine particles A covering the surface of the developer particle decreases, the flowability may not be sufficiently imparted to the developer particles.

The number average primary particle diameter of silica fine particles A is preferably in the range from 10 to 30 nm, more preferably in the range from 15 to 25 nm. The silica fine particle A is preferably fumed silica, which is more preferable if it is subjected to a hydrophobicity-imparting treatment.

In the present invention, besides the alumina fine particle, a silica fine particle B having a number average primary particle diameter of 35 to 80 nm is preferably contained as the external additive.

If the number average primary particle diameter of silica fine particles B is less than 35 nm, the spacer effect may decrease, and the printing performance may be adversely affected such as fogging. On the other hand, if the number average primary particle diameter of silica fine particles B exceeds 80 nm, the silica fine particles B may be easily released from the surface of the developer particle, the function of the silica fine particle B as the external additive may decrease, and the printing performance may be adversely affected.

The number average primary particle diameter of silica fine particles B is preferably in the range from 40 to 60 nm, which is more preferable if it is subjected to a hydrophobicity-imparting treatment.

The content of silica fine particles A is preferably in the range from 0.1 to 2 parts by mass, more preferably in the range from 0.2 to 1.5 parts by mass, even more preferably in the range from 0.3 to 1 part by mass, with respect to 100 parts by mass of colored resin particles.

The content of silica fine particles B is preferably in the range from 0.2 to 3 parts by mass, more preferably in the range from 0.3 to 2 parts by mass, even more preferably in the range from 0.5 to 1.5 parts by mass, with respect to 100 parts by mass of the colored resin particles.

If the content of silica fine particles A is less than 0.1 parts by mass, the function of external additive may not be sufficiently exhibited, the flowability may decrease, and the shelf stability and durability may decrease. On the other hand, if the content of silica fine particles A exceeds 2 parts by mass, the silica fine particles A may be easily released from the surface of the developer particle, and the charging ability may decrease under a high temperature and high humidity environment, and fog may occur.

If the content of silica fine particles B is less than 0.2 parts by mass, the function of external additive may not be sufficiently exhibited, and printing performance may be adversely affected. On the other hand, if the content of silica fine particles B exceeds 3 parts by mass, the silica fine particles B may be easily released from the surface of the developer particle, the function of the silica fine particle B as the external additive may decrease, and printing performance may be adversely affected.

As a hydrophobicity-imparting treatment agent to obtain more suitable silica fine particle A and silica fine particle B subjected to a hydrophobicity-imparting treatment, hydrophobicity-imparting treatment agents which are the same as those usable for subjecting the alumina fine particle to a hydrophobicity-imparting treatment as aforementioned may be used. It is preferable to use, for example, a silane coupling agent or silicone oil as a hydrophobicity-imparting treatment agent. These hydrophobicity-imparting treatment agents can be used alone or in combination of two or more kinds.

As the silica fine particle A, any of various commercial products can be used. The examples thereof include HDK2150 (product name; manufactured by Clariant Corp.; number average primary particle diameter: 12 nm), R504 (product name; manufactured by Nippon Aerosil Co., Ltd.; number average primary particle diameter: 12 nm), RA200HS (product name; manufactured by Nippon Aerosil Co., Ltd.; number average primary particle diameter: 12 nm), MSP-012 (product name; manufactured by Tayca Corporation; number average primary particle diameter: 16 nm), MSP-013 (product name; manufactured by Tayca Corporation; number average primary particle diameter: 12 nm), TG820F (product name; manufactured by Cabot Corporation; number average primary particle diameter: 7 nm), and TG7120 (product name; manufactured by Cabot Corporation; number average primary particle diameter: 20 nm).

As the silica fine particle B, any of various commercial products can be used. The examples thereof include NA50Y (product name; manufactured by Nippon Aerosil Co., Ltd.; number average primary particle diameter: 35 nm), VPNA50H (product name; manufactured by Nippon Aerosil Co., Ltd.; number average primary particle diameter: 40 nm), and H05TA (product name; manufactured by Clariant Corp.; number average primary particle diameter: 50 nm).

In the present invention, the silica fine particle A or the silica fine particle B may be added alone as the external additive besides the alumina fine particle, however, it is more preferable to use the silica fine particle A and the silica fine particle B in combination.

4. Electrostatic Image Developer of the Present Invention

The electrostatic image developer of the present invention contains, as the external additive, the alumina fine particle in plate-like shape subjected to a hydrophobicity-imparting treatment having a number average primary particle diameter of 20 to 120 nm and an aspect ratio of 3 to 15 in the range from 0.05 to 1 part by mass with respect to 100 parts by mass of the colored resin particle. Thereby, the electrostatic image developer of the present invention can have little change in charge amount, no generation of fog and excellent environmental stability under all of low temperature and low humidity environment, normal temperature and normal humidity environment, and high temperature and high humidity environment.

EXAMPLES

Hereinafter, the present invention will be described further in detail with reference to examples and comparative examples. However, the scope of the present invention may not be limited to the following examples. Herein, "part(s)" and "%" are based on mass if not particularly mentioned.

Test methods used in the examples and the comparative examples are as follows.

1. Production Examples and Evaluation of Colored Resin Particles 81 parts of styrene and 19 parts of n-butyl acrylate as polymerizable monomers, and 5 parts of carbon black (product name: #25B; manufactured by Mitsubishi Chemical Corporation) as a black colorant were dispersed by an in-line type emulsifying and dispersing machine (product name: EBARA MILDER; manufactured by Ebara Corporation) to obtain a polymerizable monomer mixture.

To the polymerizable monomer mixture, 1 part of a charge control resin (product name: Acrybase FCA-161P; manufactured by Fujikura Kasei Co., Ltd.) as a charge control agent, 5 parts of fatty acid ester wax (product name: WEP3; manufactured by NOF Corporation) as a release agent, 0.3 parts of polymethacrylic acid ester macromonomer (product name: AA6; manufactured by Toagosei Co., Ltd.) as a macromonomer, 0.6 parts of divinylbenzene as a crosslinkable polymerizable monomer, and 1.6 parts of t-dodecyl mercaptan as a molecular weight modifier were added, mixed and dissolved to prepare a polymerizable monomer composition.

Separately, an aqueous solution of 6.2 parts of sodium hydroxide (alkali metal hydroxide) dissolved in 50 parts of ion-exchanged water was gradually added to an aqueous solution of 10.2 parts of magnesium chloride (water-soluble polyvalent metal salt) dissolved in 250 parts of ion-exchanged water at room temperature while agitating to prepare a magnesium hydroxide colloid (hardly water-soluble metal hydroxide colloid) dispersion.

After the polymerizable monomer composition was charged into the above-obtained magnesium hydroxide colloid dispersion and agitated at room temperature, 6 parts of t-butylperoxy-2-ethylhexanoate (product name: PERBUTYL O; manufactured by NOF Corporation) was added therein as a polymerization initiator. Then, the resultant mixture was subjected to a high shear agitation at 15,000 rpm for 10 minutes to disperse by means of an in-line type emulsifying and dispersing machine (product name: EBARA MILDER; manufactured by Ebara Corporation). Thus, droplets of the polymerizable monomer composition were formed.

The suspension having the above-obtained droplets of the polymerization monomer composition dispersed (a polymerizable monomer composition dispersion) was charged into a reactor furnished with an agitating blade and the temperature thereof was raised to 90° C. to start a polymerization reaction. When the polymerization conversion reached almost 100%, 1 part of methyl methacrylate (a polymerizable monomer for shell) and 0.3 parts of 2,2'-azobis(2-methyl-N-(2-hydroxyethyl)-propionamide) (a polymerization initiator for shell; product name: VA-086; manufactured by Wako Pure Chemical Industries, Ltd.; water-soluble) dissolved in 10 parts of ion-exchanged water were added in the reactor. After continuing the reaction for another 4 hours at 90° C., the reactor was cooled by water to stop the reaction. Thus, an aqueous dispersion of colored resin particles having a core-shell structure was obtained.

The above-obtained aqueous dispersion of colored resin particles was subjected to acid washing, in which sulfuric acid was added dropwise to be pH of 6.5 or less while agitating at room temperature. Then, separation by filtration was performed, and thus a solid content was obtained. After 500 parts of ion-exchanged water was added to the solid content to make a slurry again, a water washing treatment (washing, filtration and dehydration) was performed several times. Next, separation by filtration was performed and the thus-obtained solid content was placed in a container of a dryer for drying at 45° C. for 48 hours. Thus, dried colored resin particles were obtained.

The volume average particle diameter (Dv), number average particle diameter (Dn) and particle size distribution (Dv/Dn) of the obtained colored resin particles were determined.

About 0.1 g of measurement sample (colored resin particles) was weighed out and placed in a beaker. Then, 0.1 mL of aqueous solution of alkyl benzene sulfonate (product name: DRIWEL; manufactured by FUJIFILM Corporation) was added therein as a dispersant. Further, from 10 to 30 mL of ISOTON II (product name) was added to the beaker and dispersed by means of an ultrasonic disperser at 20 W (watts) for 3 minutes. Then, the volume average particle diameter (Dv) and number average particle diameter (Dn) of the colored resin particles were measured by means of a particle diameter measuring device (product name: MULTISIZER; manufactured by Beckman Coulter, Inc.) under the condition of an aperture diameter of 100 μm, using ISOTON II as a medium, and a number of the measured particles of 100,000. Therefrom, the particle size distribution (Dv/Dn) was calculated.

The volume average particle diameter (Dv) of the obtained colored resin particles was 9.7 μm, the number average particle diameter (Dn) of the obtained colored resin particles was 8.5 μm, and the particle size distribution (Dv/Dn) was 1.14.

The average circularity of the obtained colored resin particles was determined.

A container was preliminarily filled with 10 mL of ion-exchanged water, and 0.02 g of surfactant (alkyl benzene sulfonate) as a dispersant and 0.02 g of measurement sample (colored resin particles) were added to the container. Then, dispersion treatment was performed by means of an ultrasonic disperser at 60 W (watts) for 3 minutes. The concentration of colored resin particles was adjusted to be 3,000 to 10,000 particles/μL during measurement, and 1,000 to 10,000 colored resin particles having a diameter of 0.4 μm or more by a diameter of the equivalent circle were subjected to measurement by means of a flow particle image analyzer (product name: FPIA-2100; manufactured by SYSMEX CORPORATION). The average circularity was calculated from measured values thus obtained.

The circularity is calculated by the following Calculation formula 1, and the average circularity is an average of the calculated circularities.

Circularity=a perimeter of a circle having an area same as a projected area of a particle/a perimeter of a projected particle image Calculation formula 1:

The average circularity of the obtained colored resin particles was 0.987.

2. Production Examples and Evaluation of Alumina Fine particles

Production Example 1

An aluminium hydroxide containing aqueous solution was prepared (degree of neutralization (OH amount/(Al amount×3))=1.0; pH=10.6) as a starting material by a neutralization reaction of an aluminium nitrate nonahydrate aqueous solution (Al amount: 6.9 mol) and a sodium hydroxide aqueous solution (OH amount: 21.3 mol). Upon the preparation, 1.0 wt % of sodium oleate was added in the aluminium hydroxide containing aqueous solution with respect to the theoretical boehmite yield. Thus prepared starting material was subjected to a hydrothermal reaction by means of continuous hydrothermal reaction apparatus at 350° C. and the pressure of 28 MPa for 1.3 minutes of dwell time followed by filtration, water washing and drying. Thus boehmite fine particles in plate-like shape were obtained. The obtained boehmite fine particles were subjected to heat treatment at 600° C. for 2 hours. Thus, γ-alumina fine particles (alumina fine particle(s) 1) in plate-like shape having a number average primary particle diameter of 66 nm, an aspect ratio of 5.2 and a specific surface area of 71.0 $m^2/g$ were obtained.

Production Example 2

γ-Alumina fine particles (alumina fine particles 1) obtained in Production example 1 were dispersed in 900 g of ethanol. To this ethanol dispersion while agitating, 25 g of methyltriethoxysilane (manufactured by Momentive Performance Materials Inc.) was added as a hydrophobicity-imparting treatment agent. Then, the mixed dispersion was dried under reduced pressure at 80° C. and finally subjected to heat treatment at 100° C. for 24 hours. Thus, γ-alumina fine particles (alumina fine particle(s) 2) in plate-like shape subjected to a hydrophobicity-imparting treatment were obtained.

The alumina fine particles 1 and alumina fine particles 2 were subjected to TEM observation by means of transmission electron microscope (product name: H-7600; manufactured by Hitachi, Ltd.) at the accelerating voltage of 100 kV and the magnification of 200,000 times to confirm the particle shape. The number average primary particle diameter and aspect ratio were calculated.

Figure is a TEM image of alumina fine particles 1. It can be confirmed by Figure that alumina fine particles 1 are in plate-like shape.

First, the major axis of each particle shape regarded as approximately cuboid was measured, which was referred as a particle diameter of the alumina fine particle, and the minor axis of each particle shape was measured, which was referred as a thickness of the alumina fine particle. The particle diameters of 200 or more alumina fine particles were measured and the mean value thereof was referred as the number average primary particle diameter of the alumina fine particles. Also, the thicknesses of 200 or more alumina fine particles were measured and the mean value thereof was referred as the average thickness of the alumina fine particles. In addition, the value obtained by dividing the number average primary particle diameter by the average thickness was referred as the aspect ratio of the alumina fine particles.

The number average primary particle diameter, shape and aspect ratio of each of the obtained alumina fine particle 1 and alumina fine particle 2 are shown in Table 1 below.

The particle size distributions of alumina fine particle 1 and alumina fine particle 2 were measured by the following method.

First, alumina fine particles were dispersed in aqueous dispersion to prepare a slurry. Next, the slurry obtained by dispersion in the aqueous dispersion was subjected to measurement by means of dynamic light scattering type particle size distribution measurement apparatus (product name: LB-550; manufactured by Horiba, Ltd.) and the particle size distribution (Dv90/Dv10) was calculated.

The particle size distributions (Dv90/Dv10) of the obtained alumina fine particle 1 and alumina fine particle 2 are shown in Table 1 below.

3. Production of Electrostatic Image Developer

Example 1

0.2 parts of alumina fine particle 2, 0.8 parts of silica fine particle (product name: TG7120; manufactured by Cabot Corporation) subjected to a hydrophobicity-imparting treatment having a number average primary particle diameter of 20 nm as the silica fine particle A, 1.0 part of silica fine particle (product name: H05TA; manufactured by Clariant Corp.) subjected to a hydrophobicity-imparting treatment having a number average primary particle diameter of 50 nm as the silica fine particle B were added with respect to 100 parts of colored resin particle in the above "1. Production examples and evaluation of colored resin particles", and mixed and agitated for external addition treatment by means of a high-speed agitator (product name: Henschel mixer; manufactured by Mitsui Mining Co., Ltd.) at a peripheral speed of 40 m/s for 10 minutes. Thus a developer of Example 1 was produced.

Comparative Example 1

A developer of Comparative example 1 was produced similarly as Example 1 except that 0.2 parts of alumina fine particle 2 was changed to 0.2 parts of alumina fine particle 1.

Comparative Example 2

A developer of Comparative example 2 was produced similarly as Example 1 except that 0.2 parts of alumina fine particle 2 was changed to 0.2 parts of amorphous alumina fine particle (product name: AKP-50; manufactured by Sumitomo Chemical Co., Ltd.) having a number average primary particle diameter of 130 nm.

Comparative Example 3

A developer of Comparative example 3 was produced similarly as Example 1 except that 0.2 parts of alumina fine particle 2 was changed to 0.5 parts of calcium carbonate fine particle (product name: CUBE-03BHS; manufactured by Maruo Calcium Co., Ltd.) subjected to a hydrophobicity-imparting treatment having a number average primary particle diameter of 300 nm and an aspect ratio of 1.1.

4. Property Evaluation of Developer

The electrostatic image developers of Example 1 and Comparative examples 1 to 3 were subjected to fog test and charge amount measurement.

The fog test and charge amount measurement were performed under the low temperature and low humidity (L/L) environment, the normal temperature and normal humidity (N/N) environment and the high temperature and high humidity (H/H) environment respectively. The details are as follows.

L/L environment: a temperature of 10° C. and a relative humidity of 20%

N/N environment: a temperature of 23° C. and a relative humidity of 50%

H/H environment: a temperature of 35° C. and a relative humidity of 80%

A commercially available printer of the non-magnetic one-component developing method (product name: HL-3040CN) was used for the fog test. After a developer was charged in a toner cartridge of a development device and printing paper was set in the printer, the printer was left under the high temperature and high humidity (H/H) environment having a temperature of 35° C. and a relative humidity of 80% for 24 hours.

After the printer was left for 24 hours, one print of solid patterned image with 100% image density was printed and then one print of solid patterned image with 0% image density was printed with the printer. The whiteness of the plain pattern printed paper was measured by means of a whiteness colorimeter (manufactured by Nippon Denshoku Industries Co., Ltd.). Then, a fog value (%) was calculated from the measured whiteness by the following Calculation formula 2.

(Fog value)=(whiteness of paper before printing)−(whiteness of plain pattern printed paper) Calculation formula 2:

Next, after one print of solid patterned image with 0% image density was printed, another solid patterned image with 0% image density was printed with the printer but stopping the printer in mid-course of the solid pattern printing, and then the toner attached on a developing roller was vacuumed by means of suction type charge amount measurement apparatus (product name: 210HS-2A; manufactured by TREK JAPAN) to measure the charge amount of toner, which was calculated to the charge amount per mass of the toner Q/M (μC/g).

The same tests were performed under the low temperature and low humidity (L/L) environment having a temperature of 10° C. and a relative humidity of 20%, and the normal temperature and normal humidity (N/N) environment having a temperature of 23° C. and a relative humidity of 50%, and the fog value and charge amount were calculated.

The measurement and test results of electrostatic image developers in Example 1 and Comparative examples 1 to 3 are shown in Table 1 together with the compositions of external additives.

TABLE 1

| | | Example 1 | Comparative example 1 | Comparative example 2 | Comparative example 3 |
|---|---|---|---|---|---|
| Alumina fine particle | Type of alumina fine particle | Alumina fine particle 2 | Alumina fine particle 1 | AKP-50 | |
| | Number average primary particle diameter (nm) | 59 | 66 | 130 | |
| | Particle shape | Plate-like shape | Plate-like shape | Amorphous | |
| | Aspect ratio | 5.2 | 5.2 | — | |
| | Particle size distribution Dv90/Dv10 | 1.8 | 1.7 | 3.2 | |
| | Content (part) | 0.2 | 0.2 | 0.2 | |
| | Hydrophobicity-imparting treatment | Yes | No | Yes | |
| Calcium carbonate fine particle | Number average primary particle diameter (nm) | | | | 300 |
| | Particle shape | | | | Hexahedron |
| | Aspect ratio | | | | 1.1 |
| | Content (part) | | | | 0.5 |
| | Hydrophobicity-imparting treatment | | | | Yes |
| Silica fine particle A | Number average primary particle diameter (nm) | 20 | 20 | 20 | 20 |
| | Content (part) | 0.8 | 0.8 | 0.8 | 0.8 |
| Silica fine particle B | Number average primary particle diameter (nm) | 50 | 50 | 50 | 50 |
| | Content (part) | 1.0 | 1.0 | 1.0 | 1.0 |
| Charge amount of developer (μC/g) | H/H environment | 39 | 22 | 30 | 15 |
| | N/N environment | 43 | 26 | 40 | 25 |
| | L/L environment | 39 | 40 | 50 | 45 |
| Fog in printing | H/H environment | 0.6 | 7.0 | 0.8 | 9.8 |
| | N/N environment | 0.7 | 1.5 | 0.8 | 2.0 |
| | L/L environment | 0.6 | 0.6 | 8.0 | 0.6 |

5. Summary of Developer Evaluation

Hereinafter, the developer evaluation will be reviewed with reference to Table 1.

First, the developer of Comparative example 1 will be reviewed. From the evaluation results described in Table 1, it can be understood that the developer of Comparative example 1 has a number average primary particle diameter of 66 nm, a particle shape in plate-like shape, an aspect ratio of 5.2 and a particle size distribution (Dv90/Dv10) of 1.7, and alumina fine particle 1 not subjected to a hydrophobicity-imparting treatment is contained as an external additive.

From the evaluation results described in Table 1, it can be understood that the developer of Comparative example 1 has a developer charge amount of 40 μC/g under the low temperature and low humidity (L/L) environment and a printing fog value of 0.6 under the same environment. Therefore, the developer of Comparative example 1 has no problem at least with the characteristics of the developer under the low temperature and low humidity (L/L) environment.

However, the developer of Comparative example 1 has low developer charge amount of 22 μC/g under the high temperature and high humidity (H/H) environment, and high printing fog value of 7.0 under the same environment. Also, the developer of Comparative example 1 has low developer charge amount of 26 μC/g under the normal temperature and normal humidity (N/N) environment, and high printing fog value of 1.5 under the same environment.

Therefore, it can be understood that the developer of Comparative example 1 containing alumina fine particle 1 not subjected to a hydrophobicity-imparting treatment as an external additive is inferior in the characteristics of the developer under the high temperature and high humidity (H/H) environment and the normal temperature and normal humidity (N/N) environment.

Next, the developer of Comparative example 2 will be reviewed. From the evaluation results described in Table 1, it can be understood that the developer of Comparative example 2 has a number average primary particle diameter of 130 nm, various particle shapes, and a particle size distribution (Dv90/Dv10) of 3.2, and alumina fine particles (product name: AKP-50; manufactured by Sumitomo Chemical Co., Ltd.) subjected to a hydrophobicity-imparting treatment is contained as an external additive. The aspect ratio of alumina fine particle used in Comparative example 2 was not measured.

From the evaluation results described in Table 1, it can be understood that the developer of Comparative example 2 has a developer charge amount of 30 μC/g under the high temperature and high humidity (H/H) environment and a printing fog value of 0.8 under the same environment. In addition, the developer of Comparative example 2 has a developer charge amount of 40 μC/g under the normal temperature and normal humidity (N/N) environment and a printing fog value of 0.8 under the same environment. In addition, the developer of Comparative example 2 has a developer charge amount of 50 μC/g under the low temperature and low humidity (L/L) environment. Therefore, the developer of Comparative example 2 has no problem at least with the characteristics of the developer under the high temperature and high humidity (H/H) environment and the normal temperature and normal humidity (N/N) environment, and with the developer charge amount under the low temperature and low humidity (L/L) environment.

However, the developer of Comparative example 2 has high printing fog value of 8.0 under the low temperature and low humidity (L/L) environment. This printing fog value under the low temperature and low humidity (L/L) environment is the highest among developers of Example 1 and Comparative examples 1 to 3.

Therefore, it can be understood that the developer of Comparative example 2 containing alumina fine particle (product name: AKP-50; manufactured by Sumitomo Chemical Co., Ltd.) having a number average primary particle diameter over 120 nm and a particle shape not in plate-like shape as an external additive is inferior in the characteristics of the developer under the low temperature and low humidity (L/L) environment.

Next, the developer of Comparative example 3 will be reviewed. From the evaluation results described in Table 1, it can be understood that the developer of Comparative example 3 contains calcium carbonate fine particle subjected to a hydrophobicity-imparting treatment having a number average primary particle diameter of 300 nm, a particle shape of hexahedron and an aspect ratio of 1.1 as the external additive instead of the alumina fine particle.

From the evaluation results described in Table 1, it can be understood that the developer of Comparative example 3 has a developer charge amount of 45 μC/g under the low temperature and low humidity (L/L) environment and a printing fog value of 0.6 under the same environment. Therefore, the developer of Comparative example 3 has no problem at least with the characteristics of the developer under the low temperature and low humidity (L/L) environment.

However, the developer of Comparative example 3 has low developer charge amount of 15 μC/g under the high temperature and high humidity (H/H) environment, and high printing fog value of 9.8 under the same environment. Also, the developer of Comparative example 3 has low developer charge amount of 25 μC/g under the normal temperature and normal humidity (N/N) environment, and high printing fog value of 2.0 under the same environment. The developer charge amounts of Comparative example 3 under the high temperature and high humidity (H/H) environment and the normal temperature and normal humidity (N/N) environment are respectively the lowest among the developers of Example 1 and Comparative examples 1 to 3. Also, the printing fog values of Comparative example 3 under the high temperature and high humidity (H/H) environment and the normal temperature and normal humidity (N/N) environment are respectively the highest among the developers of Example 1 and Comparative examples 1 to 3.

Therefore, it can be understood that the developer of Comparative example 3 containing calcium carbonate fine particle having a number average primary particle diameter over 120 nm as the external additive is inferior in the characteristics of the developer under the high temperature and high humidity (H/H) environment and the normal temperature and normal humidity (N/N) environment.

On the other hand, from the evaluation results described in Table 1, it can be understood that the developer of Example 1 has a number average primary particle diameter of 59 nm, a particle shape in plate-like shape, an aspect ratio of 5.2, and a particle size distribution (Dv90/Dv10) of 1.8, and contains alumina fine particle 2 subjected to a hydrophobicity-imparting treatment as an external additive.

From the evaluation results described in Table 1, it can be understood that the developer of Example 1 has high developer charge amount of 39 μC/g under the high temperature and high humidity (H/H) environment and low printing fog value of 0.6 under the same environment. Also, the developer of Example 1 has high developer charge amount of 43 μC/g under the normal temperature and normal humidity (N/N) environment and low printing fog value of 0.7 under the same environment. Also, the developer of Example 1 has high developer charge amount of 39 μC/g under the low temperature and low humidity (L/L) environment and low printing fog value of 0.6 under the same environment.

Therefore, it can be understood that the developer of the present invention containing alumina fine particle having a number average primary particle diameter of 20 to 120 nm, a particle shape in plate-like shape, and an aspect ratio of 3 to 15 has small change in charge amount and no fogging and is excellent in environmental stability under any of low temperature and low humidity environment, normal temperature and normal humidity environment and high temperature and high humidity environment.

The invention claimed is:

1. An electrostatic image developer comprising a colored resin particle containing a binder resin and a colorant, and an external additive, wherein the external additive contains an alumina fine particle in plate-like shape subjected to a hydrophobicity-imparting treatment having a number average primary particle diameter of 20 to 120 nm and an aspect ratio of 5.2to 15, and a content of the alumina fine particle is in the range from 0.05 to 1 part by mass with respect to 100 parts by mass of the colored resin particle.

2. The electrostatic image developer according to claim 1, wherein Dv90/Dv10 of the alumina fine particle is in the range from 1.5 to 3.0, wherein Dv10 represents a particle diameter at which a volume cumulative total from small particle diameter side of a particle size distribution is 10% and Dv90 represents a particle diameter at which the volume cumulative total from small particle diameter side of the particle size distribution is 90%.

3. The electrostatic image developer according to claim 1, wherein the external additive contains a silica fine particle A having a number average primary particle diameter of 5 to 30 nm, and a content of the silica fine particle A is in the range from 0.1 to 2 parts by mass with respect to 100 parts by mass of the colored resin particle.

4. The electrostatic image developer according to claim 1, wherein the external additive contains a silica fine particle B having a number average primary particle diameter of 35 to 80 nm, and a content of the silica fine particle B is in the range from 0.2 to 3 parts by mass with respect to 100 parts by mass of the colored resin particle.

5. The electrostatic image developer according to claim 1, wherein the alumina fine particle is prepared by subjecting a boehmite particle obtainable by a hydrothermal reaction to firing and a hydrophobicity-imparting treatment.

6. The electrostatic image developer according to claim 5, wherein the boehmite particle is prepared by adding a fatty acid salt to an aluminium hydroxide particle followed by a hydrothermal reaction.

* * * * *